United States Patent [19]

Jameson

[11] 4,365,437

[45] Dec. 28, 1982

[54] GYROSCOPIC WALKING TOY

[76] Inventor: John W. Jameson, 191 Heather La., Palo Alto, Calif. 94303

[21] Appl. No.: 254,504

[22] Filed: Apr. 15, 1981

[51] Int. Cl.[3] ..... A63H 11/14

[52] U.S. Cl. ..... 46/150; 180/8 D

[58] Field of Search ..... 46/150, 149, 50, 209, 46/105, 102; 180/8 R, 8 D, 8 Z, 8 C

[56] References Cited

U.S. PATENT DOCUMENTS

| | | | |
|---|---|---|---|
| 2,243,043 | 5/1941 | Walter | 46/150 X |
| 2,588,040 | 3/1952 | Perez | 46/150 X |
| 2,704,416 | 3/1955 | Laird | 46/209 X |
| 3,509,661 | 5/1970 | Ach | 46/149 |

*Primary Examiner*—Paul J. Hirsch
*Assistant Examiner*—Mickey Yu
*Attorney, Agent, or Firm*—Limbach, Limbach & Sutton

[57] ABSTRACT

A gyroscopic walking toy is described having a housing adapted to be positioned for motion in a horizontal direction, a gyroscopic element rotatably mounted from the housing for rotation in a substantially vertical plane, a leg frame and a pivot for connecting the leg frame and the housing for pivotal movement therebetween. Relative movement of the leg frame and housing is produced by a crank geared to the gyroscopic element and linked to the leg frame whereby rotation of the gyroscopic element causes relative movement of the leg frame and the housing while maintaining the gyroscopic element in a substantially vertical plane thereby lifting one of the legs off a supporting surface. Feet can be rotatably positioned at the bottom of the leg since the housing and leg frame pivot around one foot when the other foot is elevated.

7 Claims, 10 Drawing Figures

GYROSCOPIC WALKING TOY

The present invention relates generally to gyroscopic orientation stabilized articles which move generally in a horizontal direction across a supporting surface.

BACKGROUND OF THE INVENTION

The invention relates to walking toys, in particular, to those that employ a gyroscopic element as the primary inducer of the walking motion. More particularly, this invention deals with toys that employ a gyroscopic element mounted such that its plane of rotation is substantially vertical and substantially parallel to the direction of the walking motion, this plane being caused to tilt back and forth slightly away from the vertical with respect to a subframe on which are mounted two opposing legs.

Walking toys have been made previously which maintain stability on the foot in contact with the supporting surface by either shifting a counterweight away from said foot or by constructing each foot with a portion that extends under the center of gravity of the toy.

SUMMARY OF THE INVENTION

Broadly stated, this invention is directed to a walking toy having a housing adapted to be positioned for motion in at least one given horizontal direction, a gyroscopic element rotatably mounted from the housing for rotation in a substantially vertical plane and leg support means connected to the housing for supporting the housing on a support surface whereby gyroscopic action of the gyroscopic element during rotation enables lifting of a portion of the leg support means from the surface and movement of the housing about the planted portion of the leg support means before the lifted portion returns to the surface.

The preferred embodiment of the present invention is unique in that it operates in a stable fashion with widely separated feet which render it large strides, and it is also unique in that it employs a gyroscopic element to effectively lift each foot and to then in turn precess about the other foot in contact with the supporting surface.

Another aspect of the present invention is a fore-and-aft pivotal connection between the leg frame and the housing and a crank and crank-link member interconnection between the housing and the leg frame for providing the relative movement between the housing and the leg frame.

Another aspect of the present invention is the provision of a leg frame with a pair of leg members pivotally mounted on the opposite ends of the leg frame member and each having a foot pivotally connected at the lower end thereof and a leg-linking member pivotally connected to the legs so that the leg-linking member and leg-frame member maintain the legs substantially parallel.

Other features and advantages of the present invention will become more apparent upon a perusal of the following specification taken in conjunction with the accompanying drawings where similar characters of reference referred to similar elements in each of the several views.

DESCRIPTION OF THE PREFERRED EMBODIMENT

Figure 1:
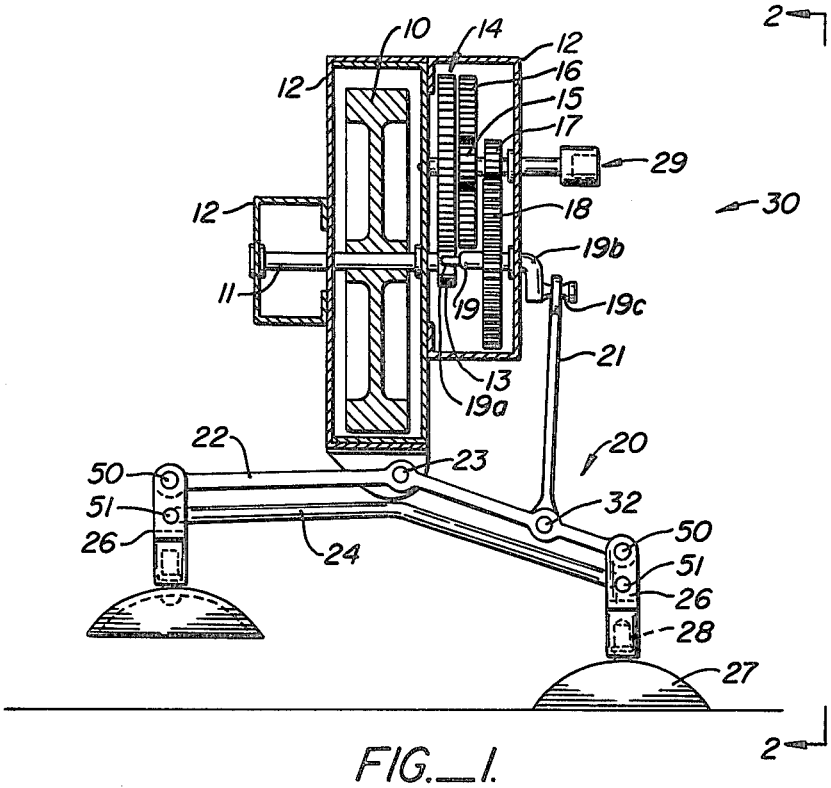
FIG. 1 is an elevational view, partially sectioned, of a toy made according to the present invention.
Figure 2:
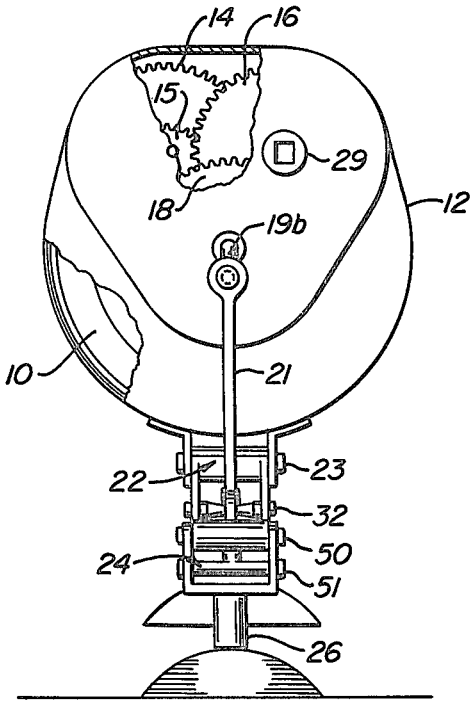
FIG. 2 is a side elevational view of the structure of FIG. 1 taken along line 2—2 in the direction of arrows of FIG. 1, partially broken away to reveal the position of the flywheel and some of the gears.

The preferred practical embodiment of the present invention is illustrated in FIGS. 1–2. A body frame or housing 12 consists of a plurality of formed plates which house the gyro element or flywheel 10 and a gear train made up of elements 13–18, all of which are rotatably mounted on the housing for rotation of the flywheel 10 in a vertical plane. A supporting leg frame 20 supports the housing 12 on an appropriate surface and is pivotally connected to the body frame 12 via a fore-and-aft pivot 23.

The flywheel 10 is affixed to a shaft 11 which is in turn affixed to a pinion 13. The pinion 13 drives a spur gear 14 which is affixed to another pinion 15, the latter positioned for driving a spur gear 16 which is affixed in turn to a pinion 17 and a hand-crank adaptor 29. Pinion 17 drives a spur gear 18 which is affixed to a crankshaft 19. One end **19*a* of the crankshaft 19 is partially supported by but not rigidly attached to the flywheel shaft 11, and the other end is provided with a crank 19*b* and crank pin 19*c***.

The leg frame 20 includes a leg frame member 22 on the opposite ends of which are rotatably mounted leg members 26 at pivots 50. A leg-linking member 24 is pivotally attached at pivots 51 to the legs 26 and serves with the leg frame member tp keep the legs parallel. A hemispherical foot 27 is provided at the lower end of each of the legs 26 and free to rotate with respect thereto by retention on a tongue and grooved shaft 28.

A crank link 21 rotatably connected on the crank pin **19*c* is pivotally connected by a pivot joint 32 to the leg frame member 22 for effecting relative movement between the leg frame 20 and the housing 12 in response to rotation of the crankshaft 19 moved by the flywheel 10**.

The toy is operated by inserting a suitable hand crank into the adapter 29 and, while holding the housing 12 in the hands, turning the crank enough to bring the flywheel 10 up to operating speed. The hand crank is then removed as the rotational energy stored in the flywheel thereafter serves to power the toy. The flywheel then continues to drive crankshaft 19 through the gear train 13–18, causing the main frame 12 to oscillate back and forth with respect to the leg frame 20, imparting the walking motion when the toy is positioned on a supporting surface.

Figure 3:
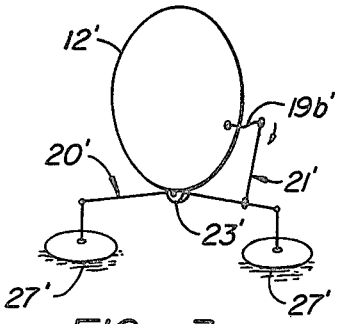
FIGS. 3–5 are schematic drawings illustrating the tilting action of the gyro and its suspension, with the feet held stationary.

The fundamental operating principle of the toy is best described with reference to the schematic views (FIGS. 3–9). In FIG. 3, the gyroscope and gear train are suspended in the housing 12'. The output of the gear train is attached to crank arm **19*b*' which in turn connects to the leg frame 20' by a link 21'. As the crank rotates, the housing 12' is caused to tilt back and forth with respect to the leg frame 20' about the fore-and-aft pivot 23'**.

Figure 4:
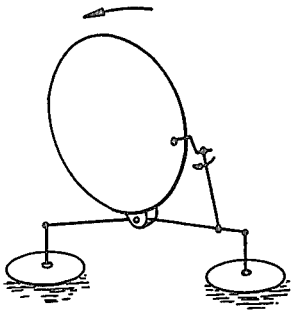
Figure 5:
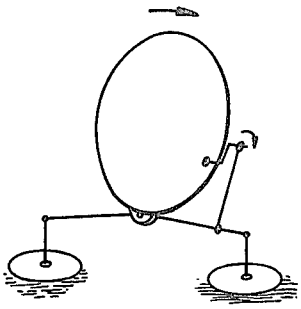
Figure 6:
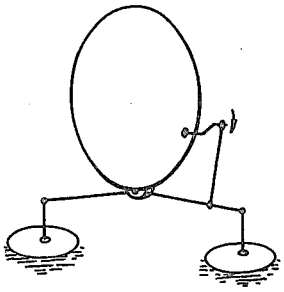
FIGS. 6—8 are schematic drawings showing the resulting motion if the feet are not held stationary.

FIGS. 4 and 5 show the resulting motion as would occur if the feet 27' were somehow fixed to the walking or supporting surface, with FIG. 4 showing a tilt of the housing to the left and then FIG. 5 a tilt to the right.

Figure 7:
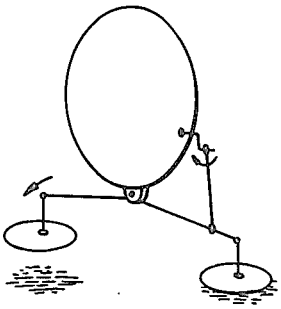
Figure 8:
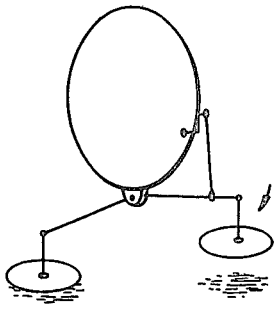

FIG. 7 shows what happens if the same conditions of FIG. 4 occur, but with the feet free to move. Instead of the housing tilting to the left, the gyroscopic element maintains the vertical attitude of the housing and thus the left foot is lifted off the surface, conserving the angle of tilt of the housing with respect to the leg frame. As soon as the left foot is off the surface, the housing pivots about the right foot as a result of the gyroscopic precession. The left foot then returns to the surface as the crank goes around whereupon the right foot is then lifted (FIG. 8) in a similar fashion, the housing then pivoting about the left foot. Since the precession about opposite feet is in the opposite direction, the result is a forward walking motion in generally one horizontal direction.

Figure 9:
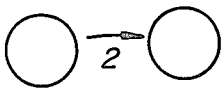
FIG. 9 is a plan view which shows the successive placement of the feet on the surface for three strides of motion.
Figure 9:
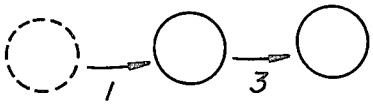

FIG. 9 shows the sequential feet placement during three strides (arc segments 1–3) of motion on the walking surface.

Due to the fact that half the weight of the entire toy is supported by the gryoscopic effect during the walking motion, it is important to keep the weight of such components as the plates and gears to a minimum. The gears of the present toy would therefore be most suitable if made from nylon or aluminum.

Figure 10:
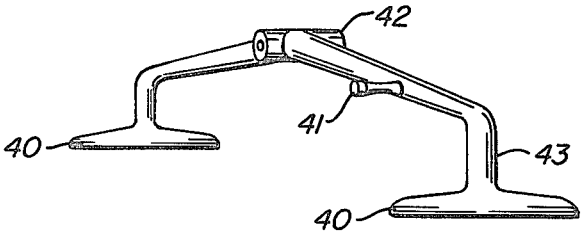
FIG. 10 is a perspective view of another possible leg arrangement.

To enhance the simplicity of the design of the FIGS. 1 and 2 toy, it is possible to replace the entire leg assembly 20 by the signal piece shown in FIG. 10. The portions of this piece are the railed feet 40, the leg section 43, the pin 41 for connecting to link 21, and the cylindrical section 42 for pivoting at 23 to the housing 12.

Simply by replacing the hemispherical feet 27 with railed feet in a fashion corresponding to FIG. 10 will not produce a stable toy due to the pivot 50 of the legs relative to the leg frame member 22 in the embodiment of FIGS. 1–2, since the leg frame member 22 and legs 26 can fall in a translational manner toward the supporting surface. Railed feet can still be attached to an embodiment such as illustrated in FIGS. 1–2 if a link 24 is pivoted to the housing 12 directly under pivot 23 thereby constraining the angle between the legs 26 and the frame to be constant.

The simplified leg arrangement of FIG. 10 has one disadvantage in that the feet 40 are forced to pivot along with the body and leg frame, thus developing a frictional resistance torque between the feet 40 and the walking surface, a condition that could be detrimental for operation on rough surfaces. This disadvantage can be overcome by allowing the feet 40 to pivot somewhat about the leg sections 43 in the same fashion as the feet 27 pivot about the legs 26, with the added requirement, however, that some elastic member be included to return the railed feet back to their original position after each pivoting about each foot (the original position being that corresponding to the single piece of FIG. 10).

Other possible mechanical arrangements other than those presented in the walking toy of FIGS. 1, 2, and 10, that would still provide the same walking action, are possible. An electric motor could be implemented to drive the flywheel, and thus propel the toy, but careful attention must be given to the entire weight of this arrangement, since the gyroscopic element could effectively lift each foot in the described fashion only if the entire weight of the toy is under a particular maximum amount.

Other mechanical varieties would include the means by which the motion of the flywheel is transmitted to cause the tilting of the body frame with respect to the leg frame, such as pulleys and/or cams. In more elaborate, sizable toys made from the present invention, the flywheel and tilting mechanism might be powered independently for the purpose of controlling the direction of the toy during the walking motion. Further mechanical variations of the invention would be the locations of the fore-and aft pivot 23 between the leg frame and the housing. This pivot may be located anywhere near the vertical line that contains the center of gravity of the body frame 10 and its contents.

What is claimed is:

1. A walking toy comprising a housing adapted to be positioned for motion in at least one given horizontal direction, a gyroscopic element for rotation, means for supporting said gyroscopic element from said housing for rotation in a substantially vertical plane, leg support means connected to said housing for supporting said housing on a support surface, said leg support means including a leg frame connected to at least two spaced apart feet, and means for pivotally mounting said feet from said leg frame whereby said housing and leg frame are able to pivot around one of said feet while the other of said feet is elevated above the support surface whereby gyroscopic action of said gyroscopic element during rotation enables lifing of a portion of said leg support means from the surface and said gyroscopic action also enables forward motion of said leg support means.

2. The walking toy of claim 1 wherein said substantially vertical plane is parallel to said one given horizontal direction and means pivotally connecting said leg frame to said housing.

3. A walking toy comprising;

a housing adapted to be positioned for motion in at least one horizontal direction, a gyroscopic element for rotation, means for supporting said gyroscopic element from said housing for rotation in a substantially vertical plane, said substantially vertical plane being parallel to said one given horizontal direction, leg support means connected to said housing for supporting said housing on a support surface and including a leg frame connected to at least two spaced apart feet, and means pivotally connecting said leg frame to said housing, said pivotally connecting means including an axis positioned substantially horizontal and aligned substantially with said one given horizontal direction.

4. A toy that undergoes walking motion comprising:

a housing, a gyroscopic element rotatably mounted within said housing for rotation in a substantially vertical plane, a leg frame, at least a pair of spaced apart feet connected to said leg frame, means for connecting said leg frame and said housing for pivotal movement therebetween, a pair of spaced apart legs connected to said leg frame and a link member pivotally connected to said legs, said link member and said leg frame maintaining said legs parallel.

5. A toy that undergoes walking motion comprising:

a housing, a gyroscopic element rotatably mounted within said housing for rotation in a substantially vertical plane, a leg frame, at least a pair of spaced apart feet connected to said leg frame, means pivotally mounting said feet from said leg frame whereby, when one of said feet is elevated, said housing and said leg frame pivot around the other of said feet, and means for connecting said leg frame and said housing for pivotal movement therebetween.

6. The toy of claim 5 including crank means rotatably mounted on said housing and interconnected with said gyroscopic element for rotational movement in accordance therewith and means linking said crank means with said leg frame for movement of said leg frame relative to said housing in response to said movement of said crank means whereby rotation of said gyroscopic element causes relative movement of said leg frame and said housing while maintaining said gyroscopic element in a substantially vertical plane thereby lifting one of said feet off a supporting surface.

7. A toy that undergoes walking motion comprising a housing a gyroscopic element rotatably mounted within said housing for rotation in a substantially vertical plane, crank means rotatably mounted on said housing gear means rotatably mounted on said housing and interconnecting said crank means with said gyroscopic element for movement of said crank in response to movement of said gyroscopic element, a leg frame comprising a leg frame member a pair of leg members pivotally mounted on opposite ends of said leg frame member a foot pivotally connected to each of said leg members, a leg linking member pivotally connected to said legs, said leg frame member and said linking member maintaining said legs substantially parallel, means pivotally connecting said leg frame and said housing for pivotal movement therebetween about a fore-and-aft pivot, and means linking said crank means with said leg frame for movement of said leg frame relative to said housing in response to movement of said crank means and said gyroscopic element whereby rotation of said gyroscopic element causes relative movement of said leg frame and said housing while maintaining said gyroscopic element in a substantially vertical plane thereby lifting one of said feet off a supporting surface and pivoting said frame around the other of said feet and then lowering said one foot and raising said other foot for rotation of said housing around said one foot thereby moving said housing in generally one horizontal direction.

* * * * *